US006883184B2

(12) United States Patent
Lee

(10) Patent No.: US 6,883,184 B2
(45) Date of Patent: Apr. 26, 2005

(54) ADJUSTABLE NOSE BRIDGE FOR SWIMMING GOGGLES

(76) Inventor: Bom Kyu Lee, 107-1604 Hanshin Apt., 76 Yangpyung-dong 5-ga, Youngdeungpo-gu, Seoul (KR), 110-350

( * ) Notice: Subject to any disclaimer, the term of this patent is extended or adjusted under 35 U.S.C. 154(b) by 170 days.

(21) Appl. No.: 10/258,388

(22) PCT Filed: Apr. 24, 2001

(86) PCT No.: PCT/KR01/00682

§ 371 (c)(1),
(2), (4) Date: Oct. 23, 2002

(87) PCT Pub. No.: WO01/80956

PCT Pub. Date: Nov. 1, 2001

(65) Prior Publication Data

US 2003/0106139 A1 Jun. 12, 2003

(30) Foreign Application Priority Data

Apr. 25, 2000 (KR) ..... 2000-11714

(51) Int. Cl.[7] ..... A61F 9/02
(52) U.S. Cl. ..... 2/446
(58) Field of Search ..... 2/428, 430, 445, 2/446; 351/128, 133

(56) References Cited

U.S. PATENT DOCUMENTS 4,468,819 A * 9/1984 Ohno ..... 2/430
5,515,551 A 5/1996 Yashiro ..... 2/428
5,687,428 A 11/1997 Yamamoto ..... 2/445
5,706,527 A 1/1998 Kita et al. ..... 2/452
5,711,036 A 1/1998 Kita et al. ..... 2/452
5,802,621 A 9/1998 Chou ..... 2/430
6,119,278 A * 9/2000 Kawashima ..... 2/428
6,282,728 B1 * 9/2001 Baragar et al. ..... 2/428
6,446,272 B1 * 9/2002 Lee ..... 2/428

* cited by examiner

*Primary Examiner*—Katherine Moran
(74) *Attorney, Agent, or Firm*—Ohlandt, Greeley, Ruggiero & Perle, L.L.P.

(57) ABSTRACT

The invention is for swimming goggles 400 with a nose-bridge 420 which can be simply adjusted to lengthen or shorten the space between lenses of the goggles and which is safe for the user even when the swimming goggles are stripped inadvertently. The novel nose-bridge 420 comprises a flexible connecting band 422 having first through-holes 422*a* towards lateral ends and second through-holes 422*b* spaced towards the midline from the first through-holes 422*a*, and supporting members 421 on each of the lenses to connect the two lenses with the flexible connecting band 422. The supporting members 421 on each lens are adapted to have a knob 421*a* extending towards the midline and each have a supporting hook member 421*b* having a blunt end 421*b'* and a hook end 421*b"*. This arrangement in combination with the flexible nature, allows for easy adjustment of the nose bridge 420 and avoids injury to the user.

13 Claims, 6 Drawing Sheets

ADJUSTABLE NOSE BRIDGE FOR SWIMMING GOGGLES

BACKGROUND OF THE INVENTION

1. Field of the Invention

The present invention relates to swimming goggles, and particularly to swimming goggles with a nose-bridge which can be simply adjusted to adjust the space between lenses of the goggles and which is safe to the user even when the swimming goggles are stripped inadvertently.

2. Description of the Related Art

Conventional swimming goggles have a pair of lens parts disposed within a predetermined distance right and left, and a nose-bridge interconnecting the midline ends of the lenses. Such nose-bridge function to maintain a given distance between interconnecting, midline ends of the pair of lenses, and for adjusting the appropriate space between the pair of lenses.

Referring to FIG. 1 wherein a prior art swimming goggles 100 having a conventional nose-bridge to adjust the space between a pair of lenses are illustrated, nose-bridge 120 connects a pair of lenses 110 by passing both ends of a connecting-band 122, in which widthwise projections 122*a*, 122*b* spaced at a predetermined distance are formed on an inner surface thereof, through respective connecting band inserting holes 121 formed on inner ends of the lenses 110. Connecting band inserting holes 121 formed on inner ends of the lenses each have a size that allows the portion of the connecting band, on which projections 122*a*, 122*b* are formed, to pass in a biased manner. Thus, when the portion 122*c* between the projections of the connecting band is positioned in the inserting hole, connecting band 122 is fixed in a state maintaining the given space between lenses 110. If the space between lenses 110 is to be narrowed, a user needs to pass inner projection 122*b* of the connecting band through connecting band inserting hole 121 formed on the midline ends of lenses 110. This is good enough if connecting band 122 of nose-bridge 120 has to perform only the function of maintaining the space between lenses 110. And connecting band 122 does not need flexibility since projections 122*a*, 122*b* formed on inner surface of connecting band 122 should not be easily passed through inserting holes 121. Therefore, the connecting bands of such nose-bridge types are generally required to be made of a rigid-plastic without elasticity.

The ends of connecting band 122 of the swimming goggles are stretched over the top of the bridge of the nose of a user when connecting band 122 is adjusted to narrow the space between lenses 110. As such, the sharp, curved portion of the rigid connecting band 122 may injure the user's skin at the ridge of the nose, especially softened by exposure to water when the swimming goggles 100 are inadvertently (or intentionally) stripped from the user's head.

In addition, as inserting hole 121 has a size that does not allow the portion of connecting band, on which projections 122*a*, 122*b* are formed, to pass easily, it is not easy to adjust the space between the lenses.

FIG. 2 depicts another prior art swimming goggles 200 having a nose-bridge 220 with another configuration as illustrated. Nose-bridge 220 has connecting band 222 on which a plurality of through-holes 222*a*, 222*b* are spaced at predetermined distances, with pass-holes 221 formed on respective inner (midline) ends of each lens so as to be aligned with any one of said through-holes 222*a*, 222*b*, when connecting band 222 is disposed between lenses 210, and fixing pins 223 inserted in any one of through-holes 222*a*, 222*b* and pass-holes 221 to affix them thereto, when a respective one of through-holes 222*a*, 222*b* and pass-holes 221 are aligned. It is inconvenient and troublesome to adjust the space between lenses 210 through removal of such fixing pins 223, align them with a pass-hole 221 with a desired through-hole, and re-inserting a fixing pin 223. Also such fixing pins 223 are easily misplaced or lost in the process.

FIG. 3 shows another conventional swimming goggles 300 having another prior art example nose-bridge 320. FIG. 3 illustrates nose-bridge 320 as being made up of a flexible connecting band 322 with through-holes 322*a*/322*b* respectively, at either ends thereof, and a connecting band support portion 321 formed on inner ends of each lens portions 310 which are linked by the connecting band. Connecting band supporting portions 321 having extending parts 321*a* extended inwardly from the inner ends of each lens 310, hooks 321*b* protrude and extend from inner surfaces of extending parts 321*a*, and protrusions 321*c* protrude outwardly from outer surfaces of the extending parts 321*a*. Hooks 321*b* and protrusions 321*c* are integrally molded with extending parts 321*a* of the inner ends of the lenses. Hooks 321*b* and protrusions 321*c* of connecting band supporting portion 321 are adapted to be supported on protrusions 321*c* after hooks 321*b* are passed into through-holes 322*a* formed at either end of connecting band 322. Such connecting band 322 has a tendency to inadvertently disengage from connecting band supporting portion 321, and also causes injury to the nose skin of the user weakened by water when the swimming goggles are inadvertently stripped as hooks 321*b* of connecting band supporting portion 321 confront the wearer's face when such swimming goggles are worn.

The present disclosure describes solutions to the problems in the prior art as identified above.

SUMMARY OF THE INVENTION

It is an object of the present invention to provide swimming goggles with a connecting band that is easily detachable to facilitate adjustment of the space between the lenses of the swimming goggles, which overcomes the drawbacks of the aforementioned prior art.

It is another object of the present invention to provide swimming goggles having a connecting band with a support member which reliably supports the connecting band to prevent the connecting band from becoming detached from the connecting band-supporting member while in use.

It is another object of the present invention to provide swimming goggles in which the connecting band supporting member is of a conformation and compositional make-up which are safe in preventing injury to a user's face even when the swimming goggles are stripped inadvertently.

Essentially, the swimming goggles or visual protective apparatus for swimming, of the present invention has the requisite pair of lenses connected with a nose-bridge at the midline ends of each lens. As the term is used herein, the "midline" is that portion of the claimed apparatus corresponding to the human midline that runs vertically from head to toe and parallel to the vertical, central surface of the nose. The longitudinal displacement of each lens and nose bridge should be considered perpendicular to this vertical midline. Thus, if a lens has two longitudinal ends, the "midline end" of a particular lens is the end towards the anatomical midline of the user and the "lateral end" is the end away from and opposite to the midline end.

In one aspect, the nose-bridge of the present invention is comprised of an independent flexible connecting band and two support members, each on respective lenses. The flexible connecting band can be made of such pliable materials of relatively soft texture as polyurethane.

The connecting band should have at least a first pair of through-holes each situated on the two lateral longitudinal ends of the band and at least a second pair of through-holes spaced towards the midline and away from the first through-holes. As already mentioned, a "lateral" disposition refers to a spatial relationship away from the vertical midline in a perpendicular, horizontal direction.

The supporting members are formed at the midline side end of each of said pair of lenses, and are adapted to connect the lenses with the flexible connecting band therebetween. Each supporting member further comprises a knob, a supporting hook member and a bar member connecting the knob to the hook member. Each knob extends from the midline side end of each lens, and each knob has a front surface and a rear surface opposite to the front surface. As used herein, the terms "front" or "outer" or "outside" refers to the surface facing away from the user when the present goggles are worn, and the terms "rear" or "inner" or "inside" refers to the surface facing towards the user's face when the present goggles are worn.

Each supporting member also has a hook member, which has an outer surface and an inner surface opposite to the outer surface, a blunt end and a hook end. The hook end is disposed opposite to the blunt end and extends laterally and a bar member connects the rear surface of the knob to the outer surface of the hook member. The hook end is integrally formed so that it is inclined towards the outer surface and away from the user's nose when the swimming goggles are worn. The remainder of the knob and hook member which are also integral to the lens taper follow the hook end and taper away from the user's nose.

Each of the two lateral longitudinal ends of the flexible connecting band are supported by corresponding supporting members on respective lenses by passing each blunt end of each supporting hook members through the first through-holes of the flexible connecting band, and then pushing each hook end of the supporting hook members through the second through-holes of the flexible connecting band by stretching a portion of the flexible connecting band between each first and second through-holes such that each first through-hole comes to rest around a respective bar member.

DETAILED DESCRIPTION OF PREFERRED EMBODIMENTS

Figure 1:
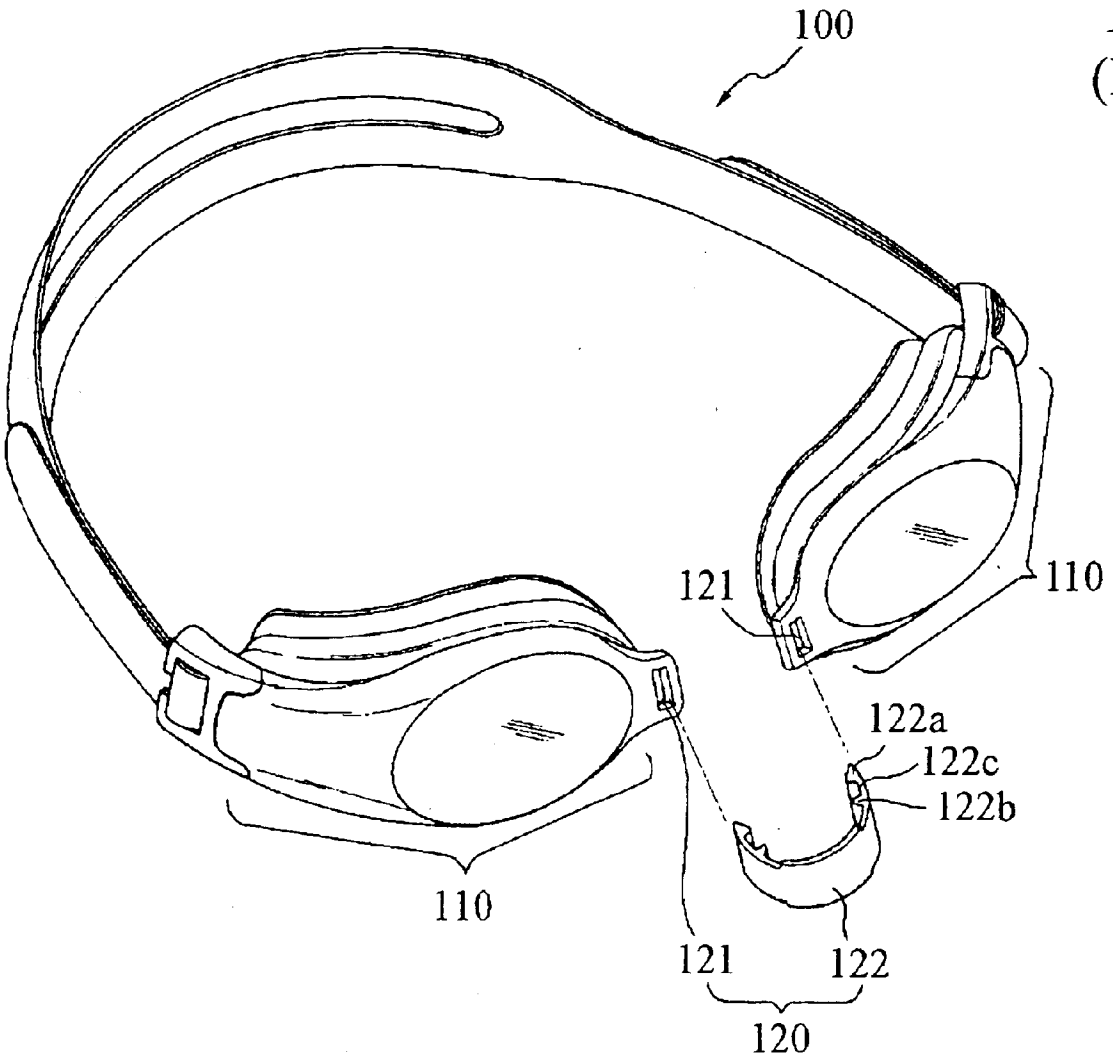
Fig. 1 (Prior art)
FIG. 1 is a perspective view of a prior art swimming goggles with a prior art nose-bridge.
Figure 2:
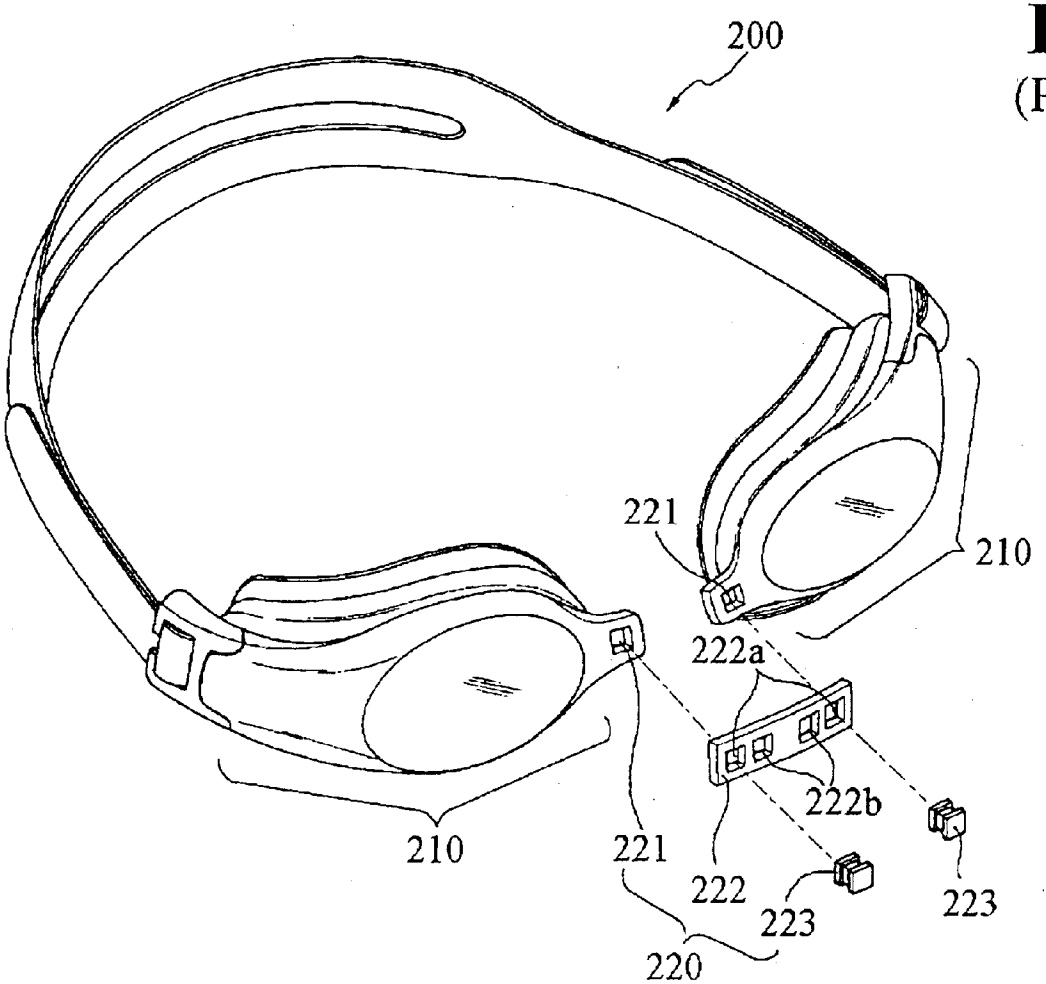
Fig. 2 (Prior art)
FIG. 2 is a perspective view of another prior art swimming goggles with a prior art nose-bridge.
Figure 3:
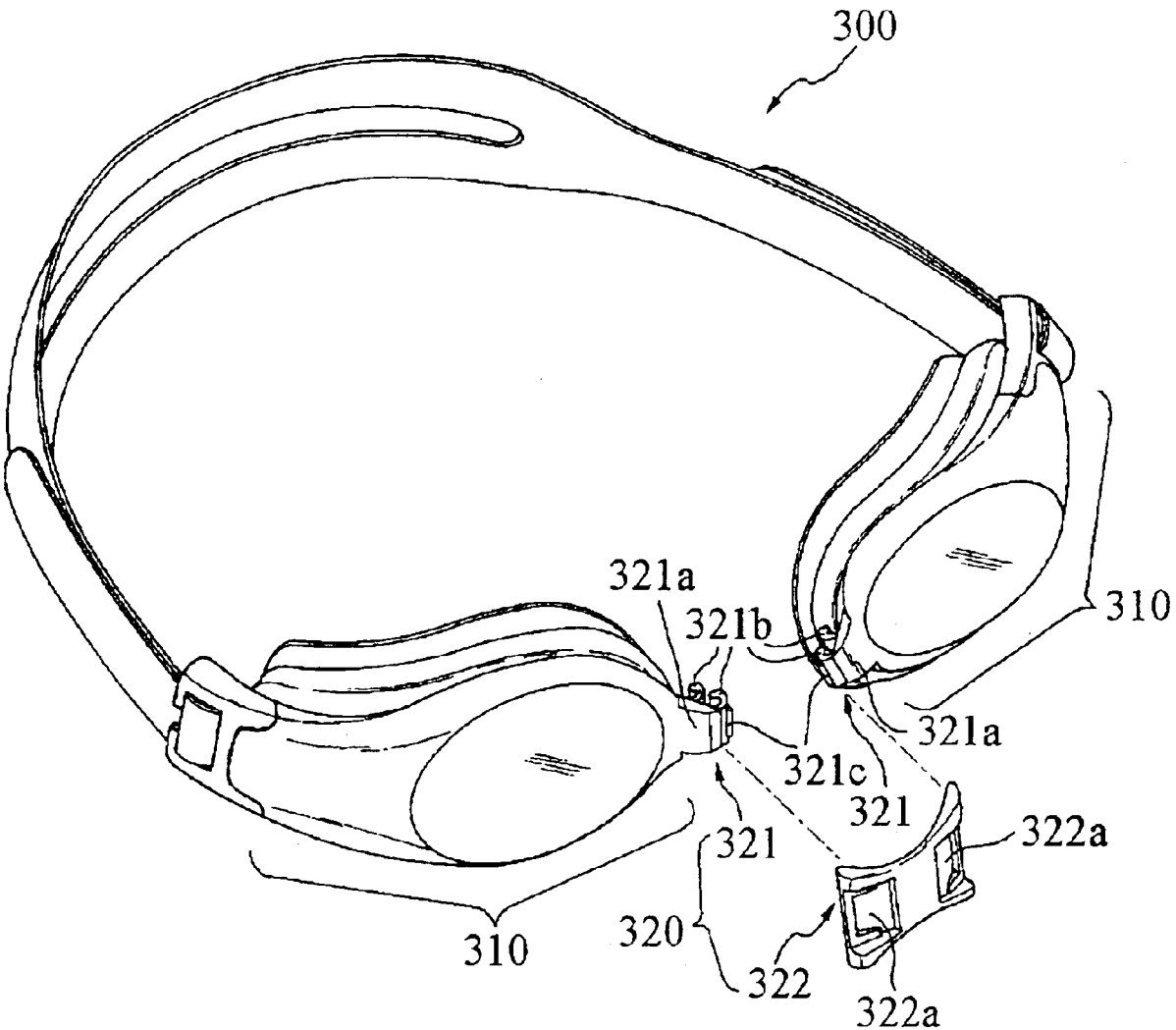
Fig. 3 (Prior art)
FIG. 3 is a perspective view of a further prior art swimming goggles with a prior art nose-bridge.
Figure 4:
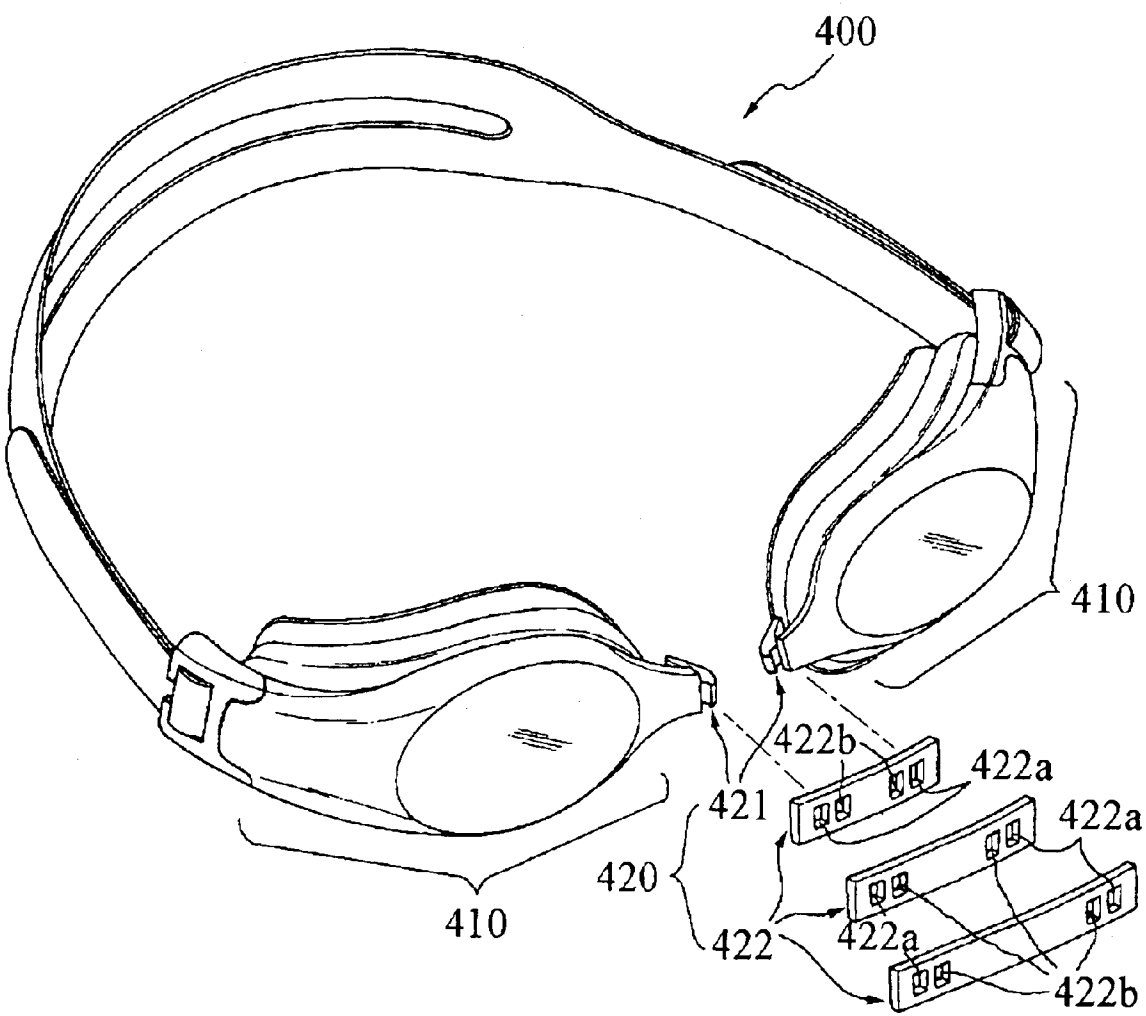
FIG. 4 is a perspective view of the swimming goggles in accordance with the present invention showing three variations in size for the inventive connecting band.

The present invention will now be described in detail with reference to the accompanying drawings. FIG. 4 shows the swimming goggles 400 comprising a pair of lenses 410, and the nose-bridge 420 adapted to connect midline ends of the lenses. As used herein the term "midline end of a lens" means the end of the lens proximate to wearer's nose when the swimming goggles are worn.

Nose-bridge 420 according to the present invention comprises first through-hole 422*a* formed adjacent either lateral ends of flexible connecting band 422 which also has second through-hole 422*b* formed and spaced apart from the first through-hole 422*a*, and connecting band supporting members 421 formed on midline ends of lenses 410, which are connected by the flexible connecting band 422.

Figure 5:
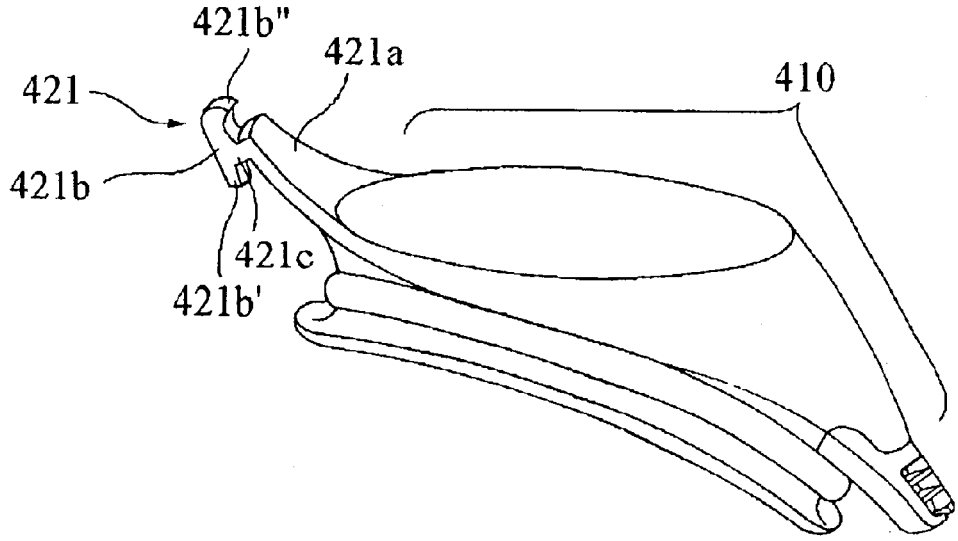
FIG. 5 shows one lens with a perspective view of a support member on the lens goggle in accordance with the present invention.

Referring to FIG. 5, supporting member 421 is specifically illustrated without flexible connecting band 422. Each supporting member 421 is formed on a respective midline end of lens 410 and comprises an extending knob 421*a,* a supporting hook member 421*b* and a connecting bar member 421*c* connecting extending knob 421*a* to supporting hook member 421*b*. As illustrated, extending knob 421*a,* supporting hook member 421*b* and connecting bar member 421*c* are all integrally formed (such as by molding) with lens 410.

Extending knob 421*a* extends towards the midline from the midline end of lens 410, and has a rear surface which faces the surface of the user's face when swimming goggles 400 are worn, and a front surface opposite to the rear surface. Supporting hook member 421*b* has an inside surface which faces the user's face when wearing the swimming goggles, and an outside surface opposite to the inside surface, a blunt end 421*b*′, and a hook end 421*b*″. Connecting bar member 421*c* connects the outside surface of hook member 421*b* with the rear surface of extending knob 421*a*.

The hook end 421*b*" is integrally formed so that it is inclined towards the outer surface and away from the user's nose when the swimming goggles are worn. The remainder of the hook member 421*b* and the knob 421*a*, which are all also integral with the lens, and are adapted to taper away from the user's nose as illustrated in FIG. 5. Thus, extending knob 421*a* inclines away from the center line of the nose of the user in order to provide more space away from the user's face. In this way, there is little danger of connecting with the nose of a person with a high nose ridge or otherwise. Also, there is little probability that the nose-bridge will contact the user's face if the swimming goggles fall off inadvertently. Therefore, there is little risk that the user will suffer injury.

Figure 6:
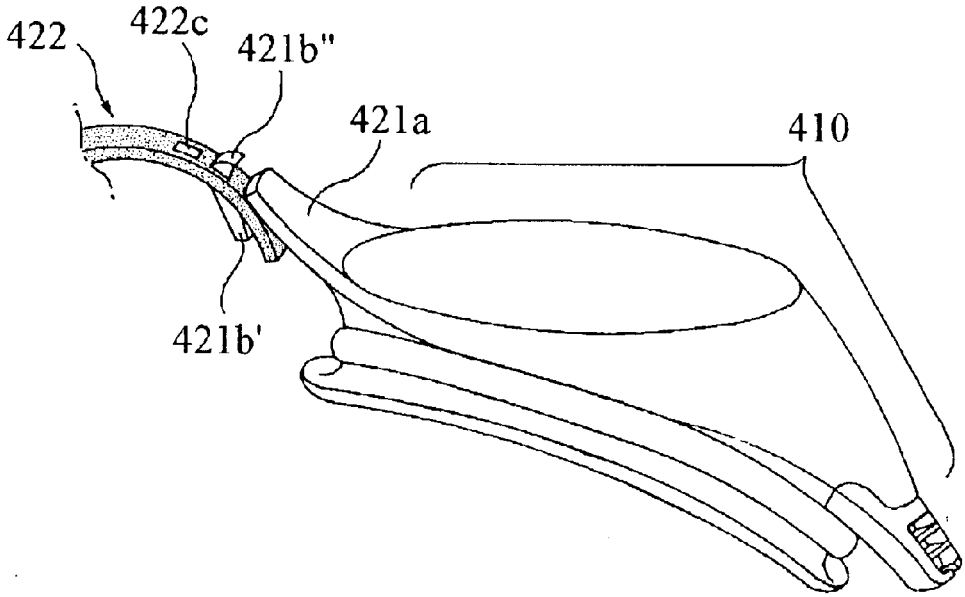
FIG. 6 depicts the lens shown in FIG. 5 along with a partial perspective view of a portion of the inventive connecting band linked and supported to the support member on the lens goggle.

FIG. 6 shows the positioning of the flexible connecting band 422 on supporting hook member 421*b* and connecting bar member 421*c* which are integral with extending knob 421*a* of the supporting member 421. The blunt end 421*b*′ of supporting hook member 421*b* are adapted to be passed through first through hole 422*a* of flexible connecting band 422 (cross reference FIG. 6 with FIG. 4). The hook end 421*b*″ (FIG. 6) are adapted to be inserted into second through hole 422*b* of flexible connecting band 422 (FIG. 4) by stretching flexible connecting band 422 so that when the ends of flexible connecting band 422 are supported by corresponding supporting means 421, first through hole 422*a* is positioned around connecting bar member 421*c*.

Through use of components which make up the nose bridge 420 of the present invention, connecting band 422 can be easily installed onto supporting member 421. Once installed, connecting band 422 is not easily dislodged from the supporting member as the hook end 421*b*″ holds it in place with second through hole 422*b* held firmly around bar member 421*c*.

The elements of the supporting member 421 are designed such that compact integral manufacture in relatively smaller dimensions compared to the prior art, are possible and thus occupy only a small space in the overall swimming goggles configuration. Thus, the overall design of the swimming goggles is varied to provide a safe structure that avoids injury to the user's face when the swimming goggles is inadvertently displaced or intentionally removed.

In order for easy installation of connecting band 422 onto swimming goggles 400, the connecting band should have some resilience. However, to conduct the function of adjusting the space between the lenses, the resilience should not be excessively high. Thus, the connecting band according to present invention is preferably made of polyurethane. Other materials which can provide such requirements as ease of installation, but not excessive resilience for adjustment, and provide safe texture, can also be substituted by one skilled in the art. All such substitutions, which will become apparent after having the benefit of this disclosure, are considered to be within the scope of this patent.

Figure 7:
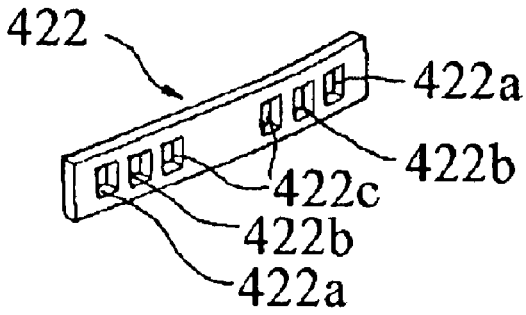
FIG. 7 is a perspective view of one embodiment connecting band of the nose-bridge in accordance with the present invention.
Figure 8:
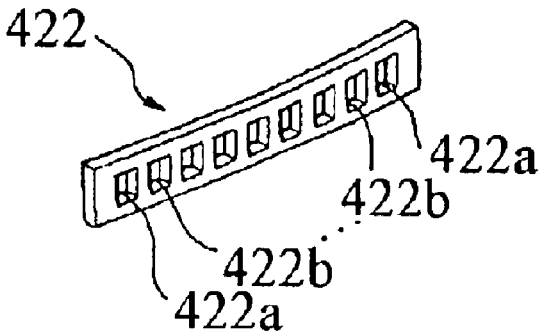
FIG. 8 is a perspective view of another embodiment connecting band of the nose-bridge in accordance with the present invention.

The illustrative embodiment has been shown with four through-holes in connecting band 422 (FIG. 4). First and second through holes 422*a*, 422*b* are formed towards the lateral longitudinal ends of the connecting band in the illustrated embodiment. FIG. 4 shows three different lengths wherein the space between the second through holes 422*b* can be varied. It will become apparent after having the benefit of this disclosure that a plurality of through holes beyond four are possible. For example, as illustrated in FIG. 7, third through holes 422*c* can be spaced toward the midline from the second through-holes 422*b* of the flexible connecting band 422. Thus, the space between lenses 410 can be narrowed by adjusting the second through-holes 422*b* and third through-holes 422*c* between the hook and connection bar member 421*c* of hook end 421*b*″ on the outside surface of supporting hook member 421*b*, when the end of flexible connecting band 422 is supported on respective supporting member 421 by stretching the flexible connecting band 422 and passing hook end 421*b*″ of supporting hook member 421*b* through third through-holes 422*c* of flexible connecting band 422, after passing blunt end 421*b*′ through second through-holes 422*b*. In addition, as illustrated in FIG. 8, a connecting band on which a plurality of through holes is formed in sequence throughout its entire length can also be used. In such a case, the number of through holes formed on the connecting band should be more than five.

The length of the flexible connecting band 422 which connects the gap between lenses 410 can be properly adjusted by preparing a set of flexible connecting band 422 whose lengths are varied such as long, medium or short, and marketing a choice for fit depending on the variable space between the user's eyes.

Illustrative embodiments of the invention have been described, and it will be understood that many changes and modifications can be made thereto without departing from the spirit or scope of the invention.

What is claimed is:

1. A visual protective apparatus for swimming which has a pair of lenses and a nose-bridge interconnecting the midline ends of said pair of lenses, said apparatus comprising:

a) a flexible connecting band having a midline, first through-holes on lateral longitudinal ends of said flexible connecting band, and second through-holes spaced towards the midline from said first through-holes; and b) supporting members formed at the midline end of each of said pair of lenses, said supporting members adapted to connect said pair of lenses with said flexible connecting band therebetween, wherein each said supporting member comprises a knob extending from the midline ends of each of said pair of lenses, said knob having a front surface and a rear surface opposite to the front surface, a supporting hook member having an outer surface, an inner surface opposite to the outer surface, a blunt end, and a hook end, said hook end disposed opposite to the blunt end and extending laterally, and a bar member connecting the rear surface of said knob to the outer surface of said supporting hook member, and wherein each end of said lateral longitudinal ends of said flexible connecting band is supported by a respective one of said supporting members by passing said blunt end of each of said supporting hook members through a respective one of said first through-holes of said flexible connecting band, and then pushing said hook end of said supporting hook member through a respective one of said second through-holes of said flexible connecting band by stretching a portion of said flexible connecting band between each of said first through-holes and each of said second through-holes so that each of said first through-holes comes to rest around a respective one of said supporting members.

2. The visual protective apparatus as in claim 1, wherein said flexible connecting band is made of polyurethane.

3. Swimming goggles made up of a first lens and a second lens and a nose-bridge connecting midline side ends of each of said first lens and second lens, said nose-bridge comprising:

a) a flexible connecting band having at least five through-holes formed through its entire length; and b) a first supporting member formed at the midline side end of said first lens and a second supporting member formed at the midline side end of said second lens, said flexible connecting band linking together said lenses such that each of said first and second lenses are connected to said flexible connecting band at each respective midline side end of said first and second lenses;

wherein said first and second supporting members each have a knob extending towards the midline from the midline side end of each of said first and second lenses, said knob having a front surface and a rear surface opposite to the front surface, a supporting hook member having an inside surface and an outside surface opposite to the inside surface, a blunt end and a hook end opposite said blunt end, and a bar member connecting said knob to said hook member, and wherein said flexible connecting band is supported by said first and second supporting members by passing said blunt end of each of said supporting hook members through a first of said through-holes and then passing said hook end of each of said supporting hook members through another of said through-holes so that each of said first through-holes comes to rest around each of said respective support members.

4. A method of connecting a swimming goggle lens to a connecting band, comprising:

passing a first portion of the lens through a first through-hole of the connecting band;

stretching sections of the connecting band proximate the first through-hole;

pushing a second portion of the lens through the first through-hole; and releasing the stretched sections of the connecting band so that the first through-hole comes to rest around a third portion of the lens, wherein the third portion joins the first and second portions to one another.

5. The method as in claim 4, further comprising hooking the second portion of the lens in a second through-hole of the connecting band, the second through-hole being spaced laterally along the connecting band from the first through-hole.

6. The method as in claim 5, further comprising adjusting a useable length of the connecting band by:

un-hooking the second portion of the lens from the second through-hole; and hooking the second portion of the lens in a third-through hole of the connecting band, the third through-hole being spaced laterally along the connecting band from the second through-hole.

7. The method as in claim 4, wherein the first portion of the lens is a blunt end of a hook member.

8. The method as in claim 7, wherein the blunt end is toward a face of a user when wearing the swimming goggle lens.

9. The method as in claim 7, wherein the second portion of the lens is a hook end of the hook member.

10. The method as in claim 9, wherein the hook end is away from a face of a user when wearing the swimming goggle lens.

11. The method as in claim 9, wherein the third portion of the lens is a connecting bar member that connects the hook member to an extending portion of the lens.

12. The method as in claim 11, wherein the hook member, the connecting bar member, and the extending portion are all integrally formed with the lens.

13. The method as in claim 4, wherein the connecting band is made of polyurethane.

* * * * *